United States Patent [19]

Ginsburg

[11] 4,148,104

[45] Apr. 10, 1979

[54] TOILET SEAT HINGE

[76] Inventor: Milton Ginsburg, 1201 Sandringham Rd., Bala Cynwyd, Pa. 19004

[21] Appl. No.: 878,718

[22] Filed: Feb. 17, 1978

[51] Int. Cl.[2] ..... A47K 13/12

[52] U.S. Cl. ..... 4/240; 4/236; 16/131

[58] Field of Search ..... 4/236, 240, 234, 237; 16/129, 130, 131, 128 R

[56] References Cited

U.S. PATENT DOCUMENTS

| | | | |
|---|---|---|---|
| 1,824,770 | 9/1931 | Brotz | 4/236 |
| 4,087,884 | 5/1978 | Seiderman | 16/128 R |

FOREIGN PATENT DOCUMENTS

| | | | |
|---|---|---|---|
| 346006 | 4/1931 | United Kingdom | 4/236 |

*Primary Examiner*—Lenard A. Footland

*Attorney, Agent, or Firm*—Paul and Paul

[57] ABSTRACT

A toilet seat hinge is provided, which permits the attachment of a toilet seat to toilet bowls having substantial variations in spacing between the holes into which the toilet seat is bolted. The hinge comprises a threaded bar around which a pair of collars are attached. Rotation of the threaded bar causes the collars to move along the length of the bar. Fastening means are attached to each of the collars, and permit the attachment of the toilet seat to toilet bowls having widely differing hole configurations. A conventional mounting means for a toilet seat cover is attached to the bar, but is not directly attached to the toilet bowl.

11 Claims, 5 Drawing Figures

TOILET SEAT HINGE

BACKGROUND OF THE INVENTION

This invention discloses a new and useful toilet seat hinge. Hinges for toilet seats have been known for many years, and are the subject of a considerable number of patented inventions. For example, the early patent of Bailey, U.S. Pat. No. 531,826 shows a toilet seat hinge which is similar to many hinges now in general use. Other inventions in this field have provided some degree of adjustability through the use of spring attachments, as exemplified in the patent to Kornhauser, U.S. Pat. No. 1,529,656.

Although many toilet bowls are of standardized dimensions, the distances between the holes in such bowls, which holes are adapted for bolting toilet seats to the bowls, are likely to vary according to the specifications of different manufacturers. But the hinges shown in the prior art allow for little or no adjustability to compensate for these variations. Rather, the hinge elements in the prior art are mounted a fixed distance apart. If the distance between these hinge elements does not match the distance between holes on the toilet bowl, the toilet seat cannot be properly mounted.

This problem of matching the hinge to the toilet bowl has been only partially ameliorated. For example, Carmichael, U.S. Pat. No. 2,032,257 provides a toilet seat hinge having some limited adjustability of distances between hinge elements. Similarly, Phillips, U.S. Pat. No. 2,846,697 deals with the problem of varying distances, and discloses an eccentric washer which compensates for minor variations in distances between holes. But the art cited herein addresses the problem only of small variations in hinge distance, and leaves unresolved the problem of attaching a given seat to toilet bowls having holes distances which vary considerably from bowl to bowl.

Part of the reason for the fixed nature of the hinges in the prior art is the desirability of rigid construction of the hinges. A toilet seat should not slide laterally over the bowl, nor should the toilet seat cover become displaced from its normal position. Therefore, any toilet seat hinge providing wide adjustability should also retain the same degree of sturdiness present in the non-adjustable forms found in the prior art.

SUMMARY OF THE INVENTION

The present invention solves the problems described above by providing an adjustable toilet seat hinge which can accommodate a wide variety of hole spacings in toilet bowls. The toilet seat is attached to a threaded bar. A pair of hinge elements, each comprising a collar fitted around the bar and a bolt-receiving means are mounted on the bar. The bar may be rotated about its longitudinal axis, and when rotated, causes the hinge elements to move along the length of the bar, due to the threaded engagement of the collar with the bar. It thus becomes possible to attach the toilet seat to a toilet bowl having holes spaced varying distances apart, while maintaining a rigid and sturdy connection between toilet seat and toilet bowl.

The threaded bar can be provided with suitable indentations which facilitate the rotation of the bar by hand, for easy adjustment of the position of the hinge elements. In the preferred embodiment, the ends of the threaded bar are further provided with cap means which prevent the collars from leaving the threaded bar in response to excessive rotation of the bar.

It is a primary object of this invention to provide a toilet seat hinge which is adaptable for easy attachment to toilet bowls having varying distances between bolt-receiving holes.

It is a further object of this invention to provide a toilet seat hinge having an adjustable attaching means for attachment of said toilet seat to said bowl, wherein the attaching means is adjustable over a substantial length of the toilet seat hinge.

It is a further object of this invention to provide a toilet seat hinge, wherein the distance between the attaching means of said hinge is capable of being finely adjusted.

It is a further object of this invention to provide an adjustable toilet seat hinge which tends to prevent excessive lateral movement of the toilet seat when said seat is bolted to a toilet bowl.

It is a further object of this invention to provide a toilet seat hinge comprising an adjustable bar which is easily rotatable.

It is a further object of this invention to provide a means for pivotable attachment of a toilet seat cover to an adjustable toilet seat hinge.

It is a further object of this invention to provide a toilet seat hinge as described above, having cap means for limiting the motion of the adjustable hinge means.

Other objects and advantages of this invention will be apparent to those skilled in the art from a reading of the following brief description of the drawings, the detailed description of the invention, and the appended claims.

DETAILED DESCRIPTION OF THE INVENTION

Figure 1:
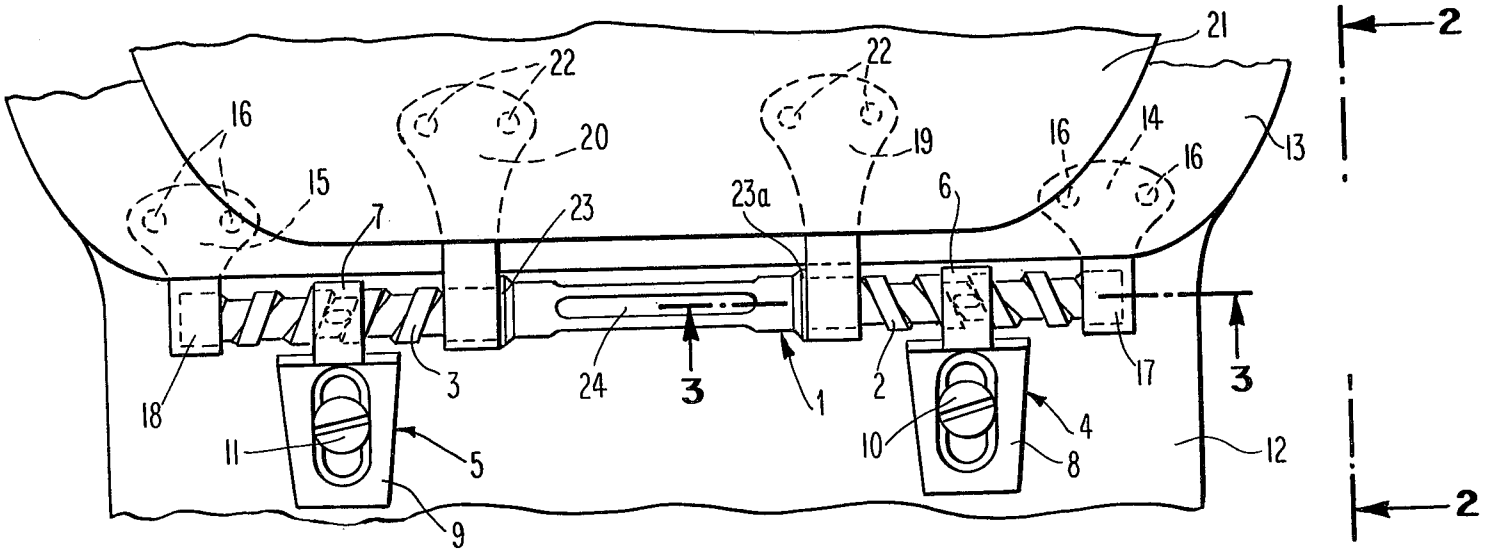
FIG. 1 is a top view of the toilet seat hinge which is the subject of this invention.

The general operation of the toilet seat hinge disclosed in the present invention can be understood with reference to FIG. 1. The hinge comprises a bar 1 which is threaded along part of its length, as indicated by the threads 2 and 3. Hinge members 4 and 5 comprise collars 6 and 7, respectively, the collars being adapted to engage the threaded portion of bar 1. Hinge members 4 and 5 further comprise bolt-receiving means 8 and 9 which receive bolts 10 and 11 for attachment of the toilet seat hinge to toilet bowl 12, shown in fragmentary form in the figure. The toilet seat hinge is connected to a toilet seat 13, shown in fragmentary form, by a pair of connectors 14 and 15 which can be screwed into toilet seat 13 through screw holes 16. Connecting means 14 and 15 further comprise caps 17 and 18 which can be fastened to the end of threaded bar 1. A second pair of connecting means 19 and 20 connect toilet seat cover 21, shown in fragmentary form, with threaded bar 1. Connecting means 19 and 20 extend entirely around the circumference of bar 1, allowing pivotable motion of seat cover 21 with respect to bar 1. Holes 22 provide means for bolting connecting means 19 and 20 to seat cover 21.

Figure 5:
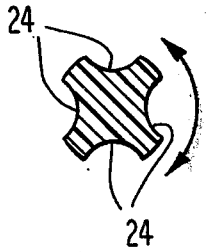
FIG. 5 is another local cross-sectional view of the toilet seat hinge, taken along the line 5—5 of FIG. 3.

The non-threaded portion of bar 1 is set off by a pair of flanges 23 and 23*a*. These flanges prevent the slidable movement of connecting means 19 and 20 toward the non-threaded portion of bar 1. The non-threaded portion also comprises four longitudinal indentations, one of which is visible in FIG. 1, and is indicated by the numeral 24. These indentations 24 are more clearly illustrated in FIG. 5 which is a cross-sectional view taken along the non-threaded portion of bar 1. Threaded bar 1 is rotatable along its longitudinal axis in either direction, as indicated by the arrows in FIG. 5. Indentations 24 facilitate the manual gripping of bar 1 and the rotating of the bar. As will be explained more fully below, rotation of bar 1 causes hinge members 4 and 5 to move along the length of the bar, thereby permitting the toilet seat hinge to be attached to toilet bowls having wide variations in spacings between bolt-receiving holes.

Figure 3:
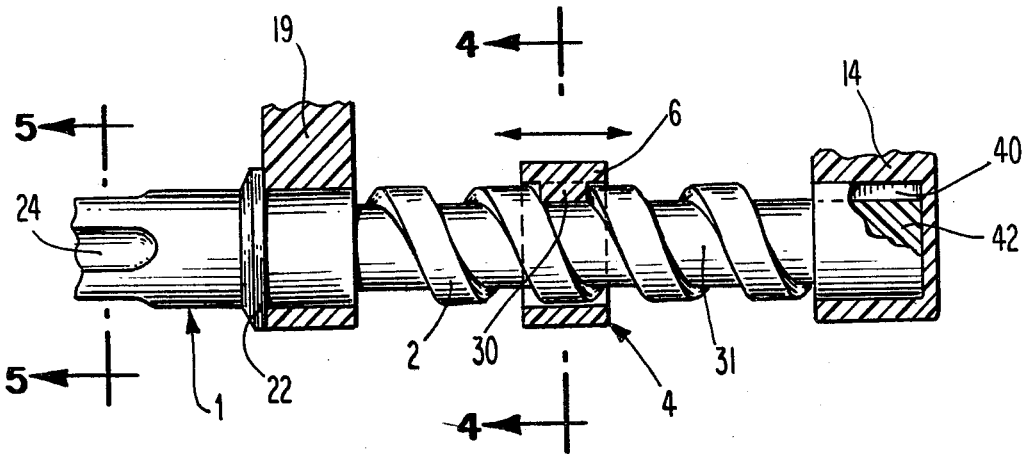
FIG. 3 is a cross-sectional view of a portion of the toilet seat hinge, taken along the line 3—3 of FIG. 1.

In the embodiment illustrated herein, the threaded bar 1 is symmetric, as its two threaded portions are identical. A detailed view of one of these threaded portions is shown in FIG. 3. Threads 2 are clearly seen on bar 1, as is flange 22 and longitudinal indentation 24. Connecting means 19 is also shown in cross-section. The most important detail of FIG. 3 concerns the inner structure of collar 6 of hinge member 4. Collar 6 has a tooth 30 protruding inward from the collar, and is of rectangular shape, and of sufficient size to mate easily with the rectangular shape of groove 31 of the threaded portion of bar 1. Thus, tooth 30 accomplishes threaded engagement between collar 6 and bar 1. Rotational movement of bar 1 causes collar 6, and therefore entire hinge member 4, to move along the length of bar 1 in either direction, as shown by the arrow. Furthermore, the threaded engagement of tooth 30 with groove 31 tends to prevent the movement of hinge member 4 along the length of bar 1, when the bar is not being turned.

Figure 4:
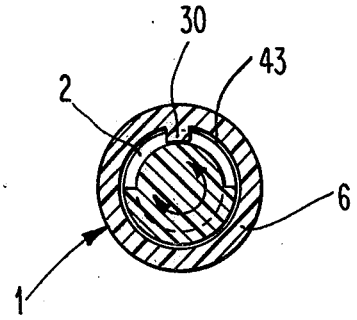
FIG. 4 is a local cross-sectional view of the toilet seat hinge, taken along the line 4—4 of FIG. 3.

The means by which the hinge members can be removed from the threaded bar is illustrated by a further detail of FIG. 3, and by FIG. 4. Groove 31 of bar 1 leads continuously into recess 40, which recess is of a shape which mates with tooth 30, whereby hinge member 4 may be removed from bar 1 by simply sliding the hinge member through recess 40, after connecting means 14 has been removed. FIG. 3 shows breakaway portion 42 of bar 1, and FIG. 4 shows more clearly the relation of tooth 30 to bar 1. Thread 2 and collar 6 are shown, separated by small gap 43. Thus collar 6 rides loosely on bar 1, but with sufficient tightness to prevent unwanted sliding along the length of the bar. As shown by the arrows in FIG. 4, bar 1 may rotate in either direction. Tooth 30 remains in its initial orientation; rotation of the bar causes the threads 2 to move, thereby causing hinge member 4 to travel along the length of bar 1.

Figure 2:
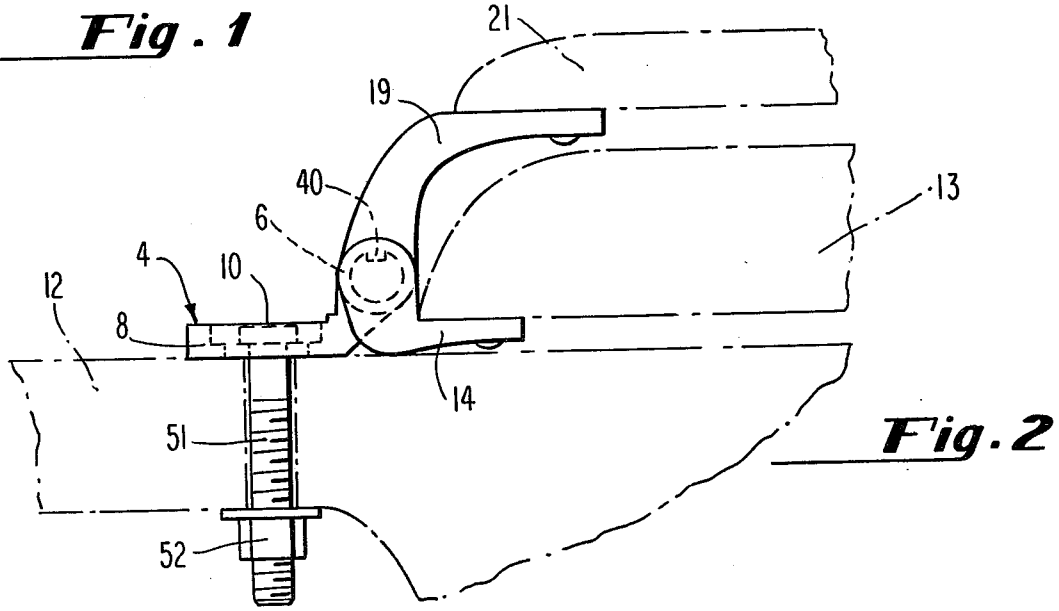
FIG. 2 is an end view of the toilet seat hinge, taken along the line 2—2 of FIG. 1.

The connection of the toilet seat hinge to a toilet bowl and a toilet seat and cover is illustrated in FIG. 2. Hinge member 4 is connected to toilet bowl 12 by a bolt 10 having threads 51 and by nut 52. Bolt 10 is screwed through the bolt-receiving means 8 of hinge member 4. Collar 6 is also visible, and the dotted lines indicate the position of recess 40. Connecting means 14 and 19 are shown, which connect the toilet seat hinge to toilet seat 13 and seat cover 21 respectively.

It will be noted, from FIG. 1, that bolt-receiving means 8 and 9 have holes which are larger than necessary to receive bolts 10 and 11. This choice of size of holes permits additional adjustability of the hinge. In particular, the entire seat may be moved, either forward or backward with respect to the toilet bowl, depending on the choice of position of bolts 10 and 11 within bolt-receiving means 8 and 9 respectively.

It is apparent that the objects of the present invention as stated above are fulfilled by the description herein. It is understood that many modifications of material and design are encompassed within the scope and spirit of the present invention. Different materials may be used to construct the various parts of the hinge. The distance between threads on the threaded bar may also be varied, within the teachings of the present invention. The embodiment described above is not to be construed to limit the scope of the invention to the particular form illustrated.

What is claimed is:

1. A hinge for affixing a toilet seat to a toilet bowl, said hinge comprising a bar, said bar being threaded along at least a portion of its length and said bar being rotatable about its longitudinal axis, means for attaching said bar to said seat, and a pair of hinge members adapted for threaded engagement with the threaded portion of said bar, wherein said hinge members further comprise means for affixing said hinge members to said toilet bowl, wherein said hinge members move along a portion of the length of said bar in response to rotational motion imparted to said bar, wherein each of said hinge members comprises a collar having a diameter of substantially the same size as the diameter of said bar, said collar comprising means for engagement with the threaded portion of said bar, and a bolt-receiving means, said bolt-receiving means being connected to said collar, each of said bolt-receiving means being respectively connected to said collar, and each of said bolt-receiving means having an aperture permitting the attachment of said collar to said toilet bowl.

2. The hinge of claim 1, wherein said bolt-receiving means permits the forward and backward adjustment of said toilet seat with respect to said toilet bowl.

3. The hinge of claim 1, wherein said engagement means comprises a tooth protruding inward from the inner diameter of said collar and adapted to fit into the threaded portion of said bar.

4. The hinge of claim 3, further comprising means for attaching a toilet seat cover to said bar, said attaching means permitting the pivotable attachment of said toilet seat cover to said bar.

5. The hinge of claim 4, wherein said bar is threaded along a substantial portion of its length, and wherein said collars move along a substantial portion of the length of said bar in response to turning motion imparted to said bar.

6. The hinge of claim 5, wherein said bar further comprises a non-threaded portion, said non-threaded portion having a plurality of longitudinal indentations, wherein said indentations facilitate the manual turning of said bar.

7. The hinge of claim 6, wherein the threaded and non-threaded portions of said bar are separated by a flange extending from said bar, said flange at least partially obstructing the lateral movement of said seat cover attaching means along said bar.

8. The hinge of claim 7, wherein each of said collars can move at least two inches along said bar, in response to turning motion imparted to said bar.

9. The hinge of claim 8, further comprising a pair of bolt means, adapted for insertion through said bolt-receiving means and through holes in said toilet bowl, wherein said bolt means connect said toilet seat to said toilet bowl.

10. The hinge of claim 9, wherein said threaded bar tends to prevent the movement of said collars along said bar when said toilet seat is in its bolted condition.

11. The hinge of claim 10, wherein the ends of said bar are inserted into a pair of caps, said caps tending to limit the excessive outward movement of said collars along said bar in response to turning motion imparted to said bar.

* * * * *